United States Patent [19]

Lenorak

[11] 4,222,221

[45] Sep. 16, 1980

[54] WINDING MACHINE WITH MULTITWIST SPINDLE

[75] Inventor: Ferdinand Lenorák, Bratislava, Czechoslovakia

[73] Assignee: Slovenska vedecko-technicka spolocnost, Dom techniky, Bratislava, Czechoslovakia

[21] Appl. No.: 958,737

[22] Filed: Nov. 8, 1978

[30] Foreign Application Priority Data

Nov. 12, 1977 [CS] Czechoslovakia ..... 7421/77

[51] Int. Cl.[3] ..... D01H 7/86; D01H 1/10

[52] U.S. Cl. ..... 57/58.49; 57/58.01; 57/58.63; 57/58.65; 57/58.83

[58] Field of Search ..... 57/58.3, 58.32, 58.49, 57/58.65, 58.67, 58.7, 58.78, 58.83, 58.61, 58.86, 62, 65

[56] References Cited

U.S. PATENT DOCUMENTS

| | | | |
|---|---|---|---|
| 2,410,674 | 11/1946 | Nelson | 57/58.61 X |
| 2,725,710 | 12/1955 | Heffelfinger | 57/58.49 X |
| 2,831,310 | 4/1958 | Berthold | 57/58.49 X |
| 2,979,882 | 4/1961 | Bromley et al. | 57/58.83 X |
| 3,066,472 | 12/1962 | Klein | 57/58.7 X |
| 3,956,875 | 5/1976 | Lenorak | 57/58.83 X |

*Primary Examiner*—Donald Watkins

*Attorney, Agent, or Firm*—Burgess, Ryan and Wayne

[57] ABSTRACT

A winding machine with a multitwist spindle for textile working of fibres and yarn with a synchronized movement of the multitwist spindle and the winding-on mechanism, both of which are mutually independently supported by a supporting frame.

7 Claims, 2 Drawing Figures

WINDING MACHINE WITH MULTITWIST SPINDLE

The invention relates to the design of a winding machine with a multitwist spindle for textile working of endless fibers and yarn, where arbitrary adjustable revolutions of a multitwist spindle and of a winding-on mechanism are synchronized.

Twisting arrangements, using single twist spindles with a rotating countershaft, double twist, three twist and multitwist spindles are known. There is no synchronizing between the spindle and the winding head in these arrangements, since all spindles on the machine have their own drive. This design cannot secure a uniform height of twists for each winding head. This irregularity reduces the quality of the thread. Another drawback of these arrangements is that the support of the spindle with regard to the takeup mechanism does not provide an arrangement utilizing standard components, so that the winding head and spindle are an independently controllable unit.

SUMMARY OF THE INVENTION

These drawbacks are eliminated by a winding machine with a multitwist spindle according to this invention, the main feature of which is that a multitwist spindle and a winding-on mechanism are independently supported by a common supporting frame. The supporting frames can be arranged one above the other or one in front of the other. The multitwist spindle with the winding-on mechanism form an independently controllable unit with a common driving shaft. A multitwist spindle is situated between a first and a second stand. A first pulley is on a right half-axle or on a half-axle if the countershaft is suspended on the half-axle. A hollow shaft terminating by a pulley and by a main pulley is fixed to the main toothed wheel. A first small pulley and a small pulley are arranged on a driving shaft between a second stand and the gear case. A first toothed wheel and a toothed wheel are connected with a take-up roller, a distributor and a guiding roller.

The advantages of the winding machine with a multitwist spindle are that the revolutions of the multitwist spindle are arbitrary adjustable with respect to the winding-on mechanism, whereby the first small pulley and the small pulley on the driving shaft, connected by a belt, by a first toothed belt and a belt provide a synchronization of revolutions of the multitwist spindle with the take-up speed of the winding-on mechanism. The common main pulley provides an independent control of the working unit.

DESCRIPTION OF THE DRAWINGS

Exemplary embodiments of a winding machine with multitwist spindle are shown on the attached drawings, wherein.

DESCRIPTION OF PREFERRED EMBODIMENTS

Figure 1:
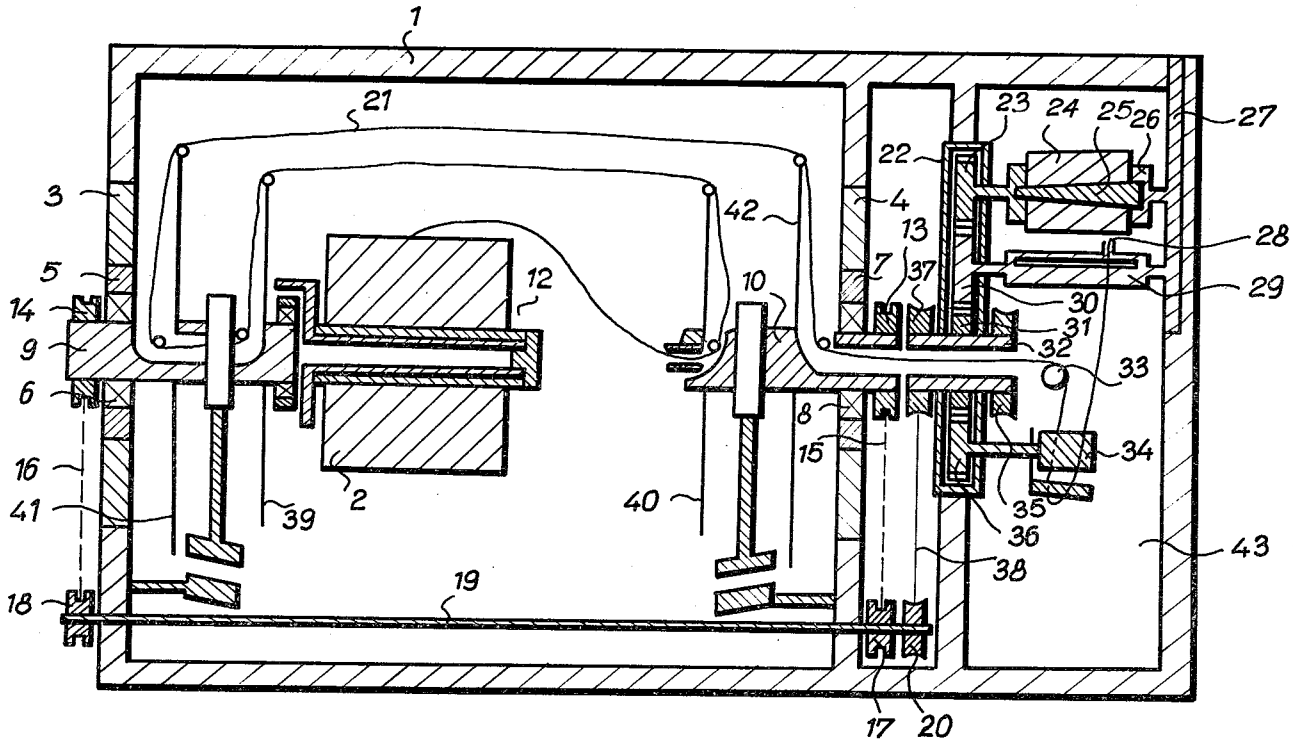
FIG. 1 is an overall sectional elevation of a winding machine with a multitwist spindle with a first external and a second internal carrier.
Figure 2:
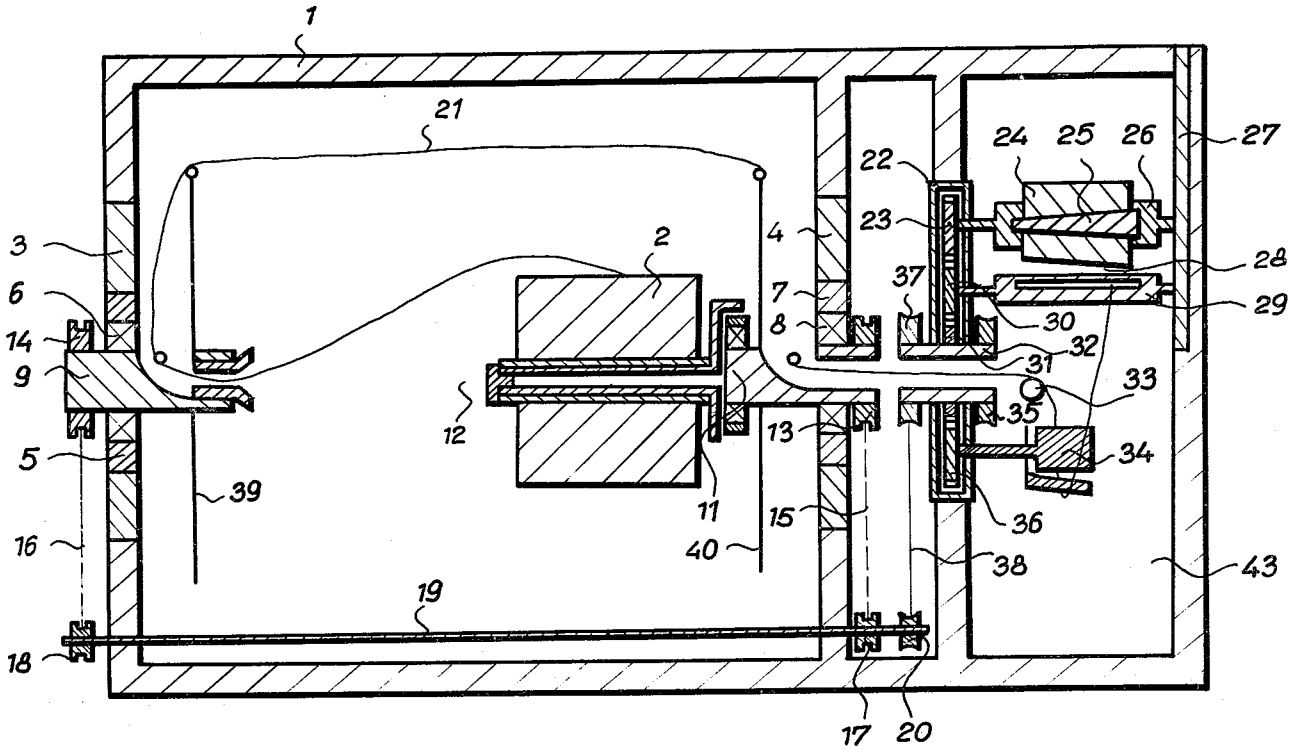
FIG. 2 is an overall sectional elevation of a winding machine with a multitwist spindle with a first internal and a second external carrier.

The winding machine according to this invention is designed so that a first stand 3, a second stand 4, a gear case 22 and a stand 27 are supported on a supporting frame 1. A multitwist spindle is arranged between the first stand 3 and the second stand 4. Its left half-axle 9, firmly connected with a first external carrier 41 and with a second pulley 14 is rotatably supported by the first bearing 6 of the first bearing housing 5, firmly connected to the first stand 3 and the right axle 10, connected firmly with the second external carrier 42 and with the first pulley 13 is rotatably supported by the second bearing 8 of the second bearing housing 7 fixed to the second stand 4. If the multitwist spindle 12 comprises solely a first internal carrier 40 as shown in FIG. 2, the half-axle 11, firmly connected to the first pulley 13, is rotatably supported by the second bearing 8. In the gear case 22, the first toothed wheel 23 firmly connected to a take-up roller 26 and a second toothed wheel 30 firmly connected to a distributor 29 are supported by the stand 27, which supports, futhermore, a main toothed wheel 31 and a toothed wheel 36, firmly connected to a guiding roller 34. A hollow shaft 32 firmly connected with the main toothed wheel 31 terminates by a pulley 37 and by a main pulley 35. A driving shaft 19 provided with a second small pulley 18, a first small pulley 17 and a small pulley 20 is rotatably connected by a second toothed belt 16, a first toothed belt 15 and a belt 38 with the second pulley 14, the first pulley 13 and the pulley 37 respectively.

The winding machine with a multitwist spindle according to this invention operates so that after starting the drive, the main pulley 35 transmits the rotating motion over the hollow shaft 32 to the main toothed wheel 31, to the second toothed wheel 30 with the distributor 29, to the first toothed wheel 23 with the take-up roller 26, to the toothed wheel 36 with the guiding roller 34 and to the pulley 37. The belt 38 transmits the motion to the small pulley 20 and over the driving shaft 19 to the first small pulley 17 and to the second small pulley 18. The first toothed belt 15 transmits the motion to the first pulley 13 and to the right half-axle 10 with the second external carrier 42 or to the half-axle 11 with the second internal carrier 40, as in FIG. 2. The second toothed belt 16 transmits the motion over the second pulley 14 to the left half-axle 9 with the first external carrier 41 or with the first internal carrier 39. The fibre 21 taken off from the counter-shaft 2 to the take-up bobbin 24 receives for one revolution of the first internal carrier 39 and the second internal carrier 40 two twist, for one revolution of the first external carrier 41 and of the second external carrier 42 further two twists. The winding machine can be advantageously used for working of endless fibers and yarn in textile and fiber working plants, where a minimum coefficient of non-uniformity of twists is required.

What is claimed is:

1. A winding machine with multitwist spindle for the working textile fibers and yarns which comprises:

a supporting frame for independently rotatably supporting and multitwist spindle and the winding-on means, a winding-on means rotatably mounted on said frame, means for providing rotary power to said winding-on means for operating said winding-on means, a multitwist spindle rotatably mounted on said supporting frame, means connecting said multitwist spindle and said winding-on means for synchronizingly rotating the multitwist spindle with the rotation of the winding-on means.

2. The winding machine of claim 1 wherein said multitwist spindle having internal and external carriers which comprises:

a first half-axle rotatably supported on one side of said frame by a first bearing of a first bearing housing, a second half-axle, rotatably mounted on a second side of said frame, opposite to said first side, by a second bearing of a second bearing housing, said first and second half-axles carrying the multitwist spindle and the internal and external carriers.

3. A winding machine with multitwist spindle for the working textile fibers and yarns which comprises:

a supporting frame for independently rotatably supporting the multitwist spindle and the winding-on means, a winding-on means rotatably mounted on said frame, means for providing rotary power to said winding-on means for operating said winding-on means, a multitwist spindle rotatably mounted on said supporting frame and having internal and external carriers, said spindle comprising a first half-axle rotatably supported on one side of said frame by a first bearing of a first bearing housing, a second half-axle, rotatably mounted on a second side of said frame, opposite to said first side, by a second bearing of a second bearing housing, said first and second half-axles carrying the multitwist spindle and the internal and external carriers, and means connecting said multitwist spindle and said winding-on means for synchronizingly rotating the multitwist spindle with the rotation of the winding-on means, said means for rotating said winding-on means comprising a rotatably mounted shaft communication with said source of power, a toothed gear firmly connected to said shaft, and a winding-on means interconnected with said toothed gear on said shaft whereby said winding-on means is operated through rotation of said shaft.

4. The winding machine of claim 3 wherein said means for operating said winding-on means comprises a first toothed gear firmly mounted on a first shaft, said first shaft being rotatably mounted on said frame and carrying a distributor, said first toothed gear meshing with said shaft mounted gear communicating with said source of power, a second toothed gear, firmly mounted on a second shaft, said second shaft rotatably mounted on said frame and carrying a take-up roller, said toothed gear on said second shaft meshing with the toothed gear on said first shaft, a third toothed gear firmly mounted on a third shaft, said third shaft rotatably mounted on said frame and carrying a guiding means for said twisted fiber, said third toothed gear meshing with said gear mounted on said shaft communicating with said source of power, said distributor, take-up roller and distributor operated by rotation of said shaft communicating with said source of power.

5. The winding machine of claim 4 wherein said shaft communicating with said source of power is a hollow shaft having a pulley firmly connected to said shaft.

6. The winding machine of claim 5 wherein said shaft communicating with said source of power has firmly mounted thereon a first pulley through which the power is transmitted to said shaft and has firmly mounted thereon a second pulley.

7. The winding machine of claim 6 wherein said second pulley on said shaft communicating with said source of power communicates with a first pulley firmly mounted on a fourth shaft rotatably mounted on said frame, said fourth shaft carrying at least one notched pulley firmly affixed to said shaft, said notched pulley in communication with said multitwist spindle by means of a notched belt whereby the rotation of the take-up roller can be synchronized with the rotation of the multitwist spindle.

* * * * *